US006193679B1

(12) United States Patent
Quinn

(10) Patent No.: US 6,193,679 B1
(45) Date of Patent: Feb. 27, 2001

(54) MASSAGING GARMENT

(76) Inventor: Gregory Quinn, 8001 Bay Pkwy., Brooklyn, NY (US) 11214

( * ) Notice: Subject to any disclaimer, the term of this patent is extended or adjusted under 35 U.S.C. 154(b) by 0 days.

(21) Appl. No.: 09/285,588

(22) Filed: Apr. 2, 1999

(51) Int. Cl.[7] ..... A61H 19/00
(52) U.S. Cl. ..... 601/97; 601/136; 601/84
(58) Field of Search ..... 601/122, 124, 601/126, 84, 97, 136, 134

(56) References Cited

U.S. PATENT DOCUMENTS

| | | |
|---|---|---|
| 4,036,491 | 7/1977 | Vierra . |
| 4,054,129 | 10/1977 | Byars . |
| 4,159,020 | 6/1979 | von Soiron . |
| 4,178,922 | 12/1979 | Curlee . |
| 4,411,258 | 10/1983 | Pujals . |
| 4,722,332 | 2/1988 | Saggers . |
| 4,732,140 | 3/1988 | Stoffregen . |
| 5,334,134 | 8/1994 | Saunders . |
| 5,381,558 | 1/1995 | Lo . |
| 5,545,125 | 8/1996 | Tseng . |
| 5,728,055 | 3/1998 | Sebastian . |
| 5,765,226 | 6/1998 | Douady ..... 2/69 |
| 5,787,541 | 8/1998 | Chen . |

*Primary Examiner*—Mickey Yu
*Assistant Examiner*—Benjamin K. Koo
(74) *Attorney, Agent, or Firm*—Boris Leschinsky

(57) ABSTRACT

A massaging garment for a massage of a selected area of the wearer's body such as the lower back, the garment is activated by the natural movements of the wearer such as walking or running and comprises a belt covering a holding frame containing a plurality of rollers positioned over the massaging plate. The holding frame is reciprocally driven by a push-pull element attached to the thigh of the wearer while walking so that the rollers cause selective compression of the raised elements of the massaging plate and thus cause the desired massaging action over the wearer's body.

8 Claims, 2 Drawing Sheets

MASSAGING GARMENT

BACKGROUND OF THE INVENTION

1. Field of the Invention

The present invention relates generally to a massaging garment capable of bringing about the effect of rubbing and kneading of at least one part of wearer's body. The garment of the invention has a particular utility in massaging the back of the wearer while walking.

2. Description of the prior art

In a modern and industrialize society, people are susceptible to the physical or a physiological illness caused by various factors such as work pressure, social pressure, family problems, etc. More and more people therefore are becoming increasingly interested in resorting to non-medical therapy, such as massage, to relieve pain, tension and fatigue. The art or massage is known to be effective in stimulating the circulatory system and making muscles or joins supple. There are a variety of massage apparatus that are available in the market today. However, people often feel that such massage apparatus are not practical in view of the fact that they afford only a temporary relief of pain and tension and that they cannot be conveniently used at any time and at any place.

There are two major categories of massage devices currently available on the market: passive devices and active devices. Passive devices act mostly to restrain and support various areas of the wearer's body. Examples of such passive devices as support and stabilizing belts are found in the U.S. Pat. No. 5,334,134 to Saunders; U.S. Pat. No. 5,728,055 to Sebastian; and U.S. Pat. No. 4,159,0202 by von Soiron. These belts are generally secured around the wearer's waist and act to support the lumbar or the lower back portion of the wearer's body. In some cases, they may include some elevated points on the surface of the belt or a garment in order to stimulate more blood flow in the area of the lower back such as described in the U.S. Pat. No. 5,765,226 by Douady, U.S. Pat. No. 5,381,558 by Lo; and U.S. Pat. No. 4,178,922 by Curlee. However, they do not contain provisions allowing for active massage of the lower back area which is the most preferred way of relieving pain.

The second category of massaging devices include active massaging elements allowing for direct and continuous stimulation of the massaging area. They typically include vibration elements driven by various sources of external power, most commonly by electrical power. Examples of these devices can be found in the U.S. Pat. No. 5,545,125 by Tseng; U.S. Pat. No. 4,732,140 by Stoffregen; and U.S. Pat. No. 4,054,129 by Byars. The need for the electrical power source is the major limitation of these devices which makes them complex and difficult to use.

The need exists therefore for a simple massaging garment with the active massaging elements in which that garment does not require the use of any sources of external power.

SUMMARY OF THE INVENTION

Accordingly, and is an object of the present invention to overcome these and other drawbacks of the prior art by providing a novel massaging garment capable of active massaging action over a selected area of the wearer's body and which does not require the use of an external power source.

It is another object of the present intention to provide a massaging garment in which the motions of the massaging elements are driven by the natural movements of the wearer such as walking, running, sitting down, and the like.

It is a further object of the invention to provide a massaging apparatus with the massaging elements driven by at least one or preferably a pair of parallel push-pull means where these push-pull means are attached to the wearer's body so that they are activated by the natural movements of the wearer extremities such as legs or arms.

It is yet another object of the invention to provide a massaging garment capable of being placed around the wearer's waist in a manner similar to a wide belt which can be done both over the wearer's clothes or under them.

In the preferred embodiment, the massaging garment of the present invention comprises a plurality of massaging elements such as rollers held in place by a pair of holding frames which in turn are held firmly against the lower back of the wearer by a wide belt. A pair of push-pull elements is placed under the belt and is connected at one end to the corresponding holding frame so that reciprocal movements of the push-pull elements cause corresponding reciprocal movements of the holding frame and in turn cause the massaging rollers to roll up and down the massaging plate and therefore massage the area of the skin located in direct contact with the massaging plate.

Push-pull elements are connected at the other end to the leg attachment means so that the motion of walking or running causes the push-pull elements to move reciprocally up and down which in turn causes the desired massaging action of the garment.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

Figure 1:
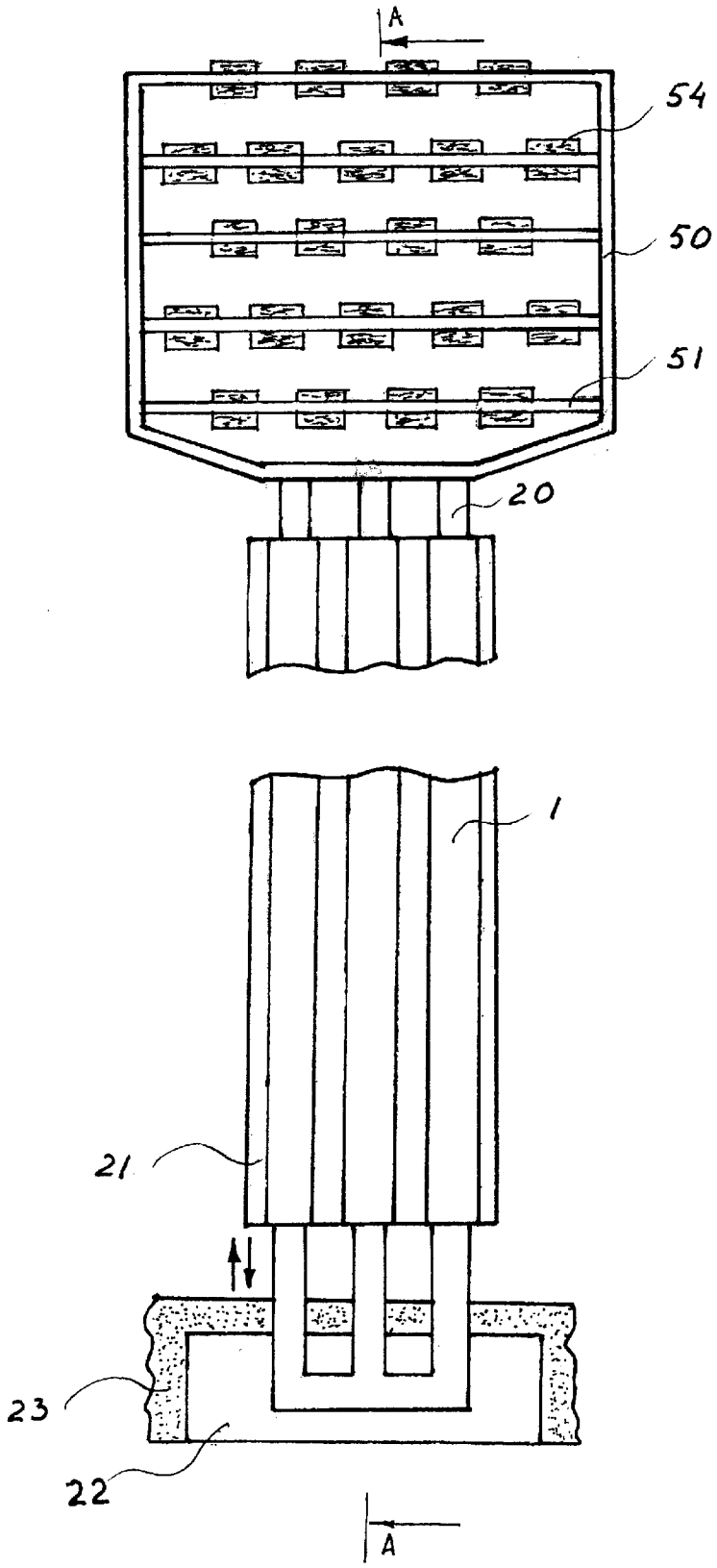
FIG. 1 is a front view of one of the push-pull elements attached to the corresponding holding frame and the leg attachment means (certain elements are not shown for clarity of illustration)

A detailed description of the present invention follows with reference to the accompanying drawings in which like elements are indicated by like reference numerals.

Figure 3:
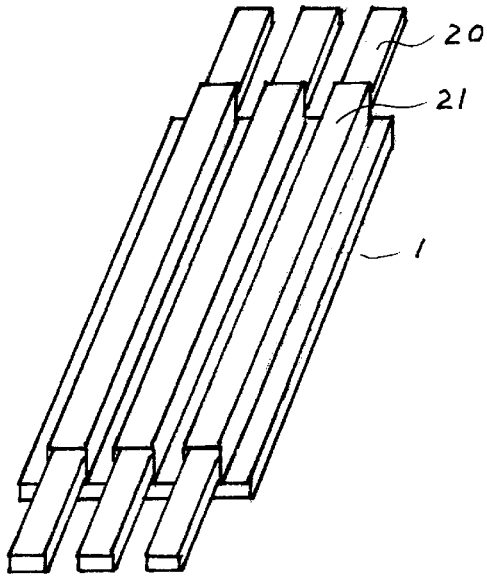
FIG. 3 is a general view of the push-pull element of the present invention; and finally

FIG. 1 illustrates several major components of the massaging garment of the present invention driven by the natural movements of the legs of the wearer during walking or running. Massaging elements of the garment are driven by a pair of push-pull elements (1) one of which is illustrated on FIG. 1 as having its upper end connected to the holding frame (50) and its lower end connected to the leg attachment element (22). As can be seen from FIGS. 1 and 3, push-pull element (1) is designed to contain a plurality of movable flat components (20) enclosed within the housing (21) and having the ability of reciprocal motions. Flat components (20) can be made of polymer or other semirigid material preferably with a low coefficient of friction as long as they do not elongate by themselves while in use. Flat components (20) shall be somewhat flexible at the same time to repeat the contours of the human body.

The lower ends of the flat components (20) are connected to the leg attachment means consisting of a semi-rigid plate (22) attached to the piece of non-extendable fabric (23) which firmly surrounds the wearer's thigh. This piece of fabric can be a separate belt or be a part of the underwear. The purpose of the firm attachment of the flat components (20) to the thigh of the wearer is to utilize the motion of the leg of the wearer in such a way that when the leg is moved forward, the flat components (20) are moved down and subsequently, when the leg is moved back, the flat components (20) are moved up. The motions of both legs therefore are used to activate the massaging action of the garment As shown on FIGS. 1 and 4, the upper end of the flat components (20) is attached to the holding frame (50). Frame (50) in turn contains a plurality of rollers (54) each located on a holder (53) extending from the plurality of parallel frame components (51) oriented to be perpendicular to the direction of reciprocal motions of the flat components (20). Holders (53) and rollers (54) are preferably arranged in a alternate pattern so that reciprocal movements of the holding frame (50) causes a broad massaging action over the whole area of the skin under the holding frame (50). Rollers (54) can be made from a variety of rigid materials such as polymers, rubber, wood, metals and alike.

Although rollers (54) may be used directly to cause the skin massage, it is suggested in this preferred embodiment to use the reciprocal motions of these rollers to activate the massaging action of the massaging plate (60). Plate (60) contains a plurality of raised elements (62) located on both sides of the generally planar non-extendable fabric (61) as best shown on FIG. 4. Massaging plate (60) is held in firm contact with the skin (70) of the wearer's back by the belt (30). Raised elements (62) located against the skin (70) would cause massaging action once pressed down by the movements of the rollers rolling over them. In that case, the friction of the moving rollers would not cause any harmful effect on the skin as would happen should no massaging plate is utilized in the garment. Various shapes of the raised elements (62) are contemplated such as with sharp or flat tops although only an example of the round shape is illustrated on the drawing. Raised elements (62) can be made from a variety of rigid materials such as wood, polymers, metals and alike.

Figure 4:
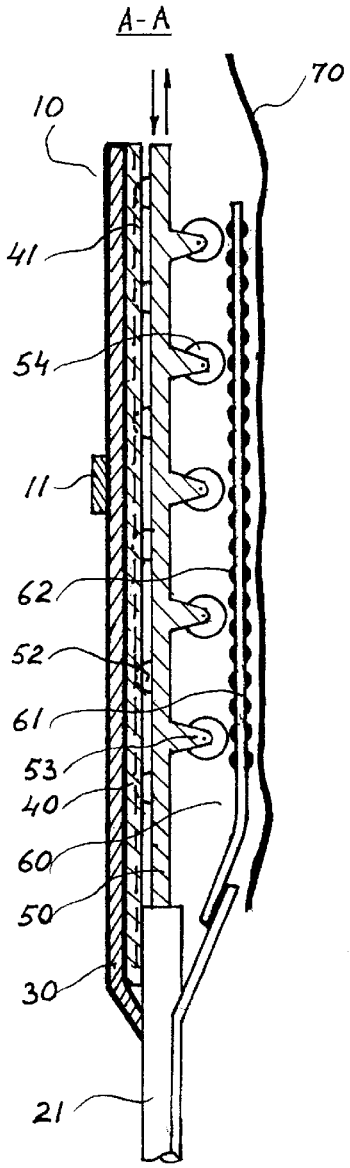
FIG. 4 is a cross-sectional view of the massaging garment of the present invention.

As shown on FIG. 4, the massaging garment (10) consists generally of a wide belt (30) covering a supporting plate (40) which in turn is operably connected with the holding frame (50) and indirectly with the massaging plate (60). Regular pants belt (1) can be used over the massaging garment if desired.

The belt (30) in its lower end is attached to the semi-rigid plate (21) of each of the two push-pull elements (1) described above. Any flexible but non extending material can be used to make the wide belt (30) the design of which is similar to supporting wide belts generally known to be used, for example, during lifting of heavy objects.

The inside surface of the belt (30) is attached to the supporting plate (40) having a plurality of vertical grooves (41) designed to accept corresponding raised elements (52) of the holding frame (50). Such arrangement is needed to reduce the friction between the vertically moving holding frame (50) and the stationary supporting plate (40) since only a faction of the surface area of both components is now in direct contact with one another. Another purpose is to prevent accidental side movements of the holding frame (50).

Figure 2:
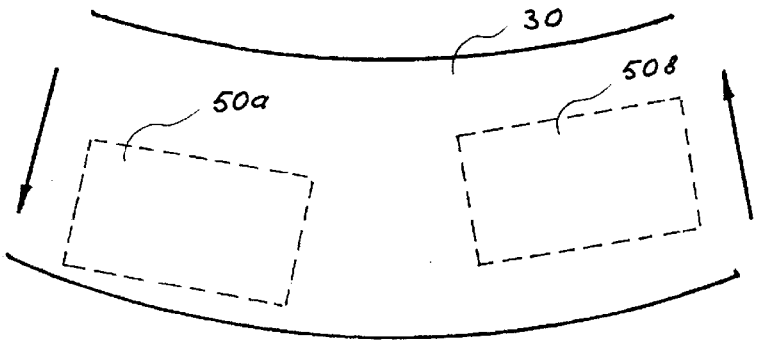
FIG. 2 is a schematic representation as seen from the back of the wearer of the movements of the holding frames under the belt of the garment in the position where the left leg is moved forward and the right leg is moved back.

In use, the massaging action of the wearer's back is activated during walking, running or similar natural movements of the wearer. As shown on FIG. 2, as the left leg of the wearer is moved forward, the leg attachment means (22) cause the flat components (20) to move down in the left push-pull element causing the down movement of the corresponding left holding frame **(50*a*) while the opposite occurs in the right push-pull element where the flat components are moving up causing the same motion of the corresponding right holding frame (50*b*)**.

Rollers (54) which are pressed firmly against the massaging plate (60) by the supporting plate (40) and the belt (30), are moving down with the left holding frame **(50*a*) and correspondingly up with the right holding frame (50*b*). Moving rollers (54) cause selective compression of the raised elements (62) of the massaging plate (60) which in turn cause the desired massaging action of the garment against the skin (70)** of the wearer's lower back.

Once the left step is completed, the direction of massage action reverses. As the right leg is moving forward now, the left holding frame **(50*a*) is moving up while the right holding frame (50*b*) is moving down That completes the cycle of massaging action of both holding frames (50*a*) and (50*b*)** and the garment is set for the next massaging cycle.

Although the garment of the present invention is described for a specific massage area such as the lower back of the user, it is not limited thereto. Numerous variations and modifications would be readily appreciated by those skilled in the art such as an application of the massaging garment for the massaging of the upper body of the wearer using the driving motion of the natural movements of the wearer's arms. These modifications and applications are intended to be included in the scope of the invention, which is restricted only by the following claims.

I claim:

1. A massaging garment for active massaging of a selected area of a wearer's upper body, said garment comprising:

a massaging means adapted to be positioned against said selected area of the wearer's upper body;

a belt means positioned over said massaging means, said belt means providing compression of said massaging means against said selected area of the wearer's upper body; and an activation means for driving said massaging means, said activation means adapted to be attached to the wearer's legs, whereby the natural motions of the wearer's legs causing said activation means to drive said massaging means to provide the desired massaging action.

2. The massaging garment as in claim 1, wherein said activation means comprises a push-pull element, said push-pull element having a first end and a second end, said push-pull element being attached at the first end to said massaging means, said push-pull element being adapted to be attached at the second end to the wearer's leg by a leg attachment means, whereby the natural motions of the wearer's leg causing said push-pull element to cause reciprocal motions of said massaging means.

3. The massaging garment as in claim 2, wherein said activation means comprising a left push-pull element and a right push-pull element, each push-pull element positioned along a corresponding leg of the wearer.

4. The massaging garment as in claim 1, wherein said massaging means comprising a plurality of rollers, said rollers rotatably fixed on a holding frame, said holding frame capable of reciprocal motions, said holding frame being driven by said activation means, whereby the reciprocal motions of said holding frame causing said rollers to rotate while moving reciprocally along said selected area of the wearer's body.

5. The massaging garment as in claim 4, wherein said rollers being placed in an alternate pattern.

6. The massaging garment as in claim 4, wherein said massaging means further comprising a massaging plate, said massaging plate positioned between said holding frame and said selected area of the wearer's body, said massaging plate having a plurality of raised elements, whereby the reciprocal motions of said holding frame causing said rollers to press said raised elements against said selected area of the wearer's body providing the desired massaging action.

7. The massaging garment as in claim 4, wherein said massaging means further comprising a supporting plate, said supporting plate positioned between said belt means and said holding frame.

8. The massaging garment as in claim 7, wherein said holding frame further comprising a plurality of raised elements, said supporting plate having a corresponding plurality of grooves, said grooves accepting said raised elements of said holding frame, whereby said supporting plate acting provide for reciprocal motions of said holding frame with reduced friction.

* * * * *